US006036056A

United States Patent [19]

Lee et al.

[11] Patent Number: 6,036,056

[45] Date of Patent: Mar. 14, 2000

[54] AUTOMATIC SOAP DISPENSING DEVICE

[76] Inventors: Kuo-Chou Lee, No. 93, Shang-Jen Street, Noan Noan, Keelung City; Tsang-Chang Hwang, 5F, No. 65, Fwu-Kuo Rd., Shih Lin, Taipei, both of Taiwan

[21] Appl. No.: 08/851,453

[22] Filed: May 5, 1997

[51] Int. Cl.[7] ..... B67D 5/06

[52] U.S. Cl. ..... 222/63; 222/105; 222/181.3; 222/207; 222/325; 222/333

[58] Field of Search ..... 222/63, 105, 181.3, 222/185.1, 207, 325, 333

[56] References Cited

U.S. PATENT DOCUMENTS 5,105,992 4/1992 Fender et al. ..... 222/333
5,249,718 10/1993 Muderlak ..... 222/333
5,344,047 9/1994 Chen ..... 222/63
5,492,247 2/1996 Shu et al. ..... 222/207

*Primary Examiner*—Joseph A. Kaufman
*Attorney, Agent, or Firm*—Bacon & Thomas, PLLC

[57] ABSTRACT

An automatic soap dispensing device, particularly a device which can be activated by photoelectric or infrared sensor via a control circuit, i.e., a motor reducing gear set in a drive device driving a drive wheel with a considerable torque at low speed so that an eccentric wheel on the drive wheel can push a squeezer set which in turn squeeze a soap hose to dispense liquid soap accordingly; and a micro switch is touched when the drive wheel is rotated to a certain angle to stop the motor, upon which the squeezer set returns its initial position by the inherent elasticity of the hose without any need to engage any gear with the reducing gear set and possibility of seizure between gears which may adversely affect operation of the soap dispensing device.

2 Claims, 5 Drawing Sheets

AUTOMATIC SOAP DISPENSING DEVICE

BACKGROUND OF THE INVENTION (a) Field of the Invention

The present invention relates to an automatic soap dispensing device, particularly an automatic soap dispensing device which can be activated by a sensor to dispense liquid soap in a predetermined quantity automatically and precisely.

(b) Description of the Prior Art

Common soap dispensing devices, which are used extensively in the public places (e.g., washrooms, etc.), generally contain a bag of cleaning agent (i.e., liquid soap) in a housing, one end of which is connected to a soap-dispensing hose running through a seat. Soap dispensing devices include manual soap dispensing devices and automatic soap dispensing devices. Some manual devices, such as that disclosed in U.S. Pat. No. 4,256,242, squeeze the cleaning agent with a pressing cap, which, however, would most probably become a medium for spreading of communicable diseases since it is to be touched by all kinds of people coming and going in the public places. Some automatic soap dispensing devices, such as that disclosed in U.S. Pat. No. 5,492,247, use a photoelectric or infrared sensor to initiate a drive device which, via a reducing gear set, drives a liner rack to displace forward using a small gear. A block on the front side surface of the rack thus presses on a hose; thereby a precise volume of liquid is squeezed and dispensed. An automatic device disclosed in U.S. Pat. No. 5,105,992 has a motor to drive a contact roller set, which presses the hose to squeeze the liquid out in the fixed amount. Another automatic device under U.S. Pat. No. 4,722,372 has an eccentric wheel to drive the pressing rod which in turn presses the hose to squeeze the liquid out in the fixed amount.

SUMMARY OF THE INVENTION

The main objective of the present invention is to provide an automatic soap dispensing device having a motor with reducing gear set to drive a drive wheel with a considerable torque at low speed and having a spiral eccentric wheel on the drive wheel to drive a squeezer set to squeeze a hose for dispensing of liquid soap without the need of engagement of any gear. Moreover, every tooth on the drive wheel and the reducing gear set is subject to an uniform force so that the squeezer set can squeeze the hose gradually with a minimum electric power consumption.

Another objective of the present invention is to provide an automatic soap dispensing device in which a microswitch is contacted when the drive wheel reaches a certain position after the hose is squeezed to dispense the liquid soap so that the motor is stopped and in which the squeezer set returns to its initial position by the elasticity of the hose, without need of electric power.

Another objective of the present invention is to provide an automatic soap dispensing device, in which the pressing force of the drive wheel and the motor reducing gear set is evenly taken up by every gear tooth, which, as a result, will not get deformed easily when the torque force is strong, therefore being applicable to a soap liquid of high viscosity.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENTS

Figure 1:
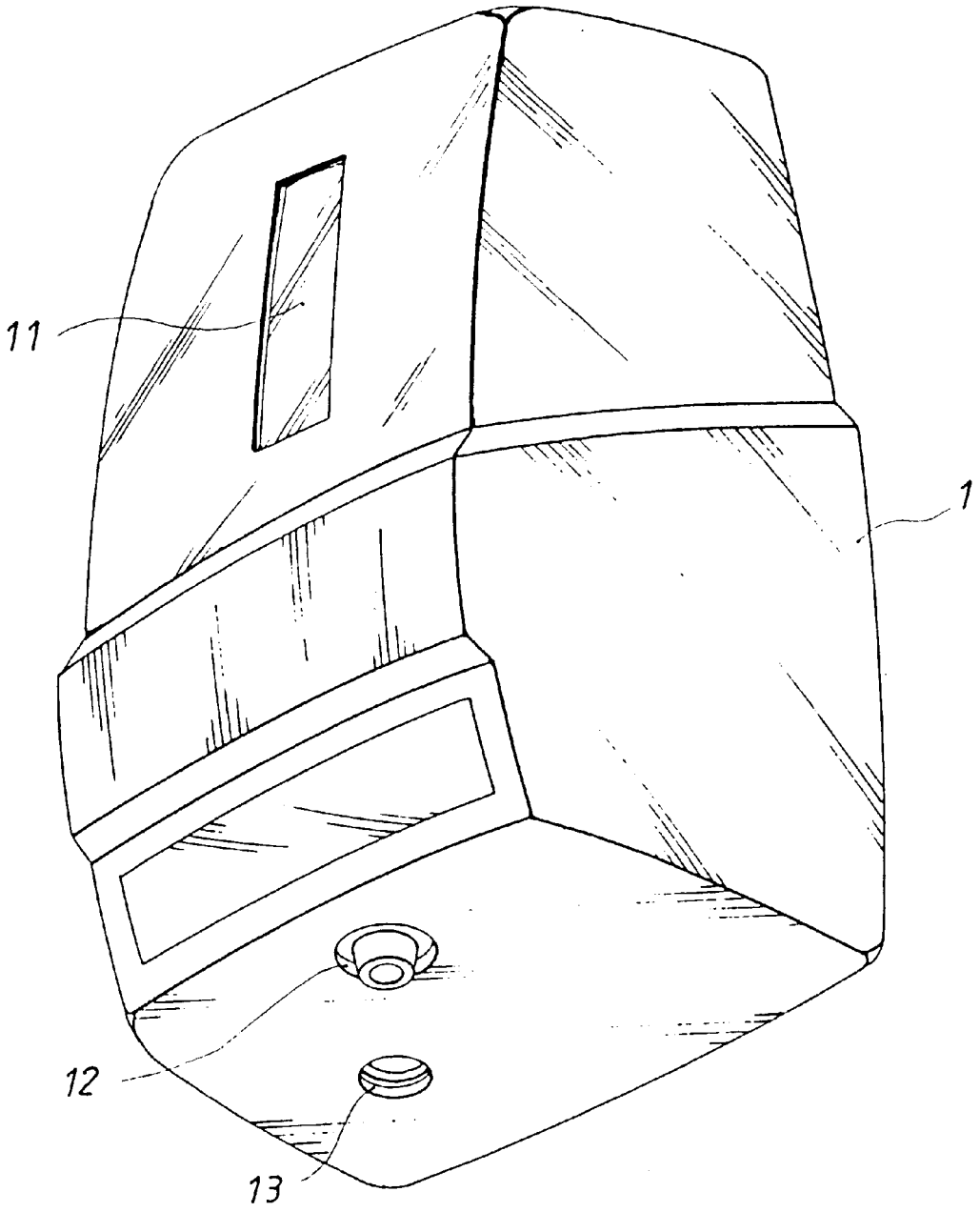
FIG. 1 is a perspective view of the present invention.
Figure 2:
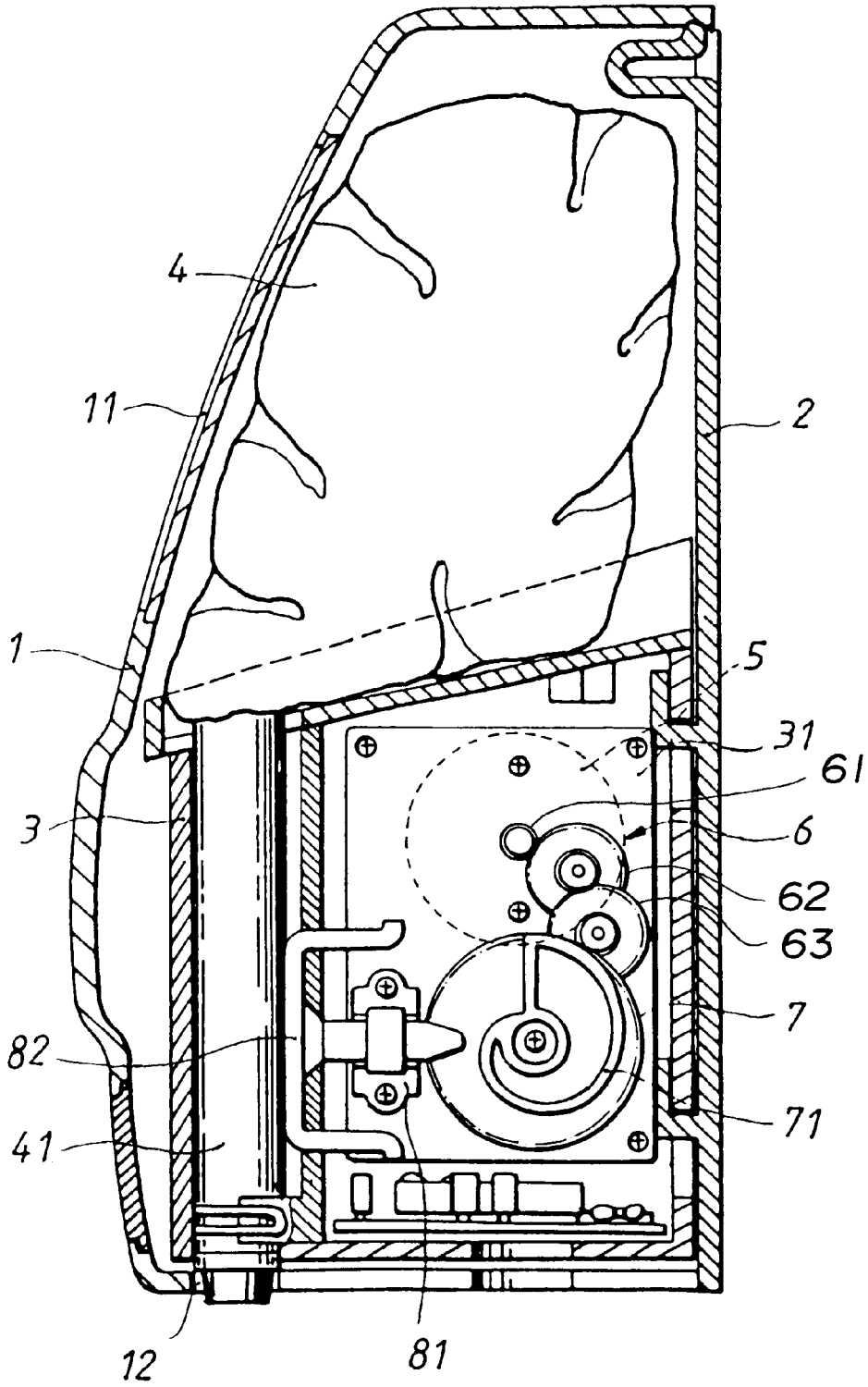
FIG. 2 is a sectional view of an assembly according to the present invention.
Figure 3:
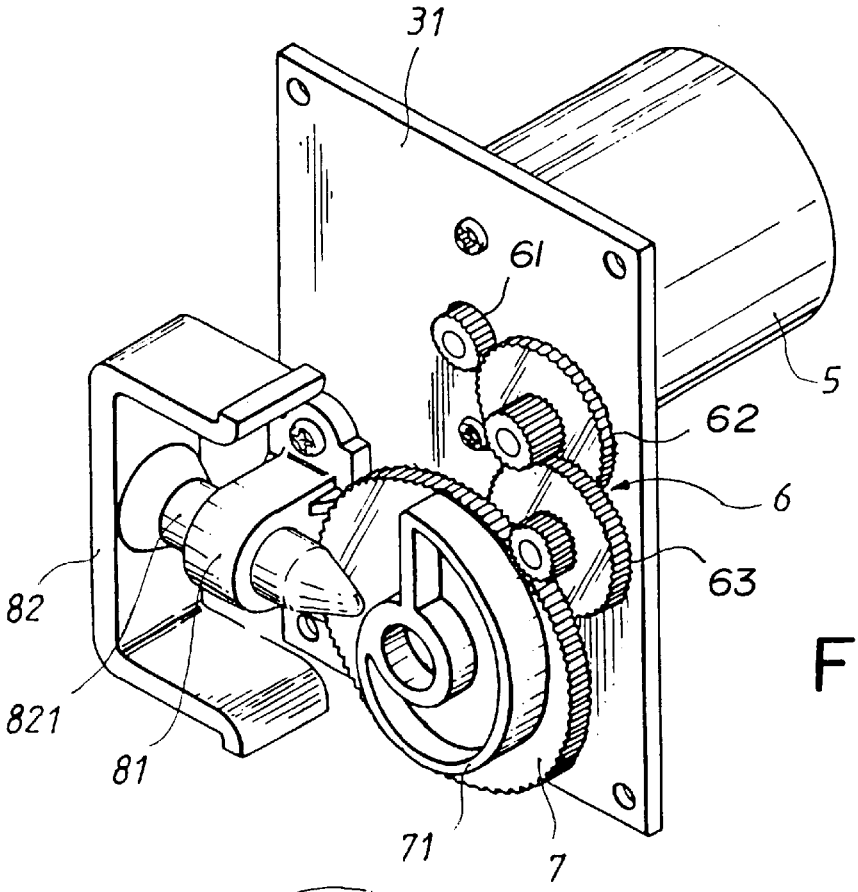
FIG. 3 is a perspective view of a preferred embodiment according to the present invention.
Figure 3A:
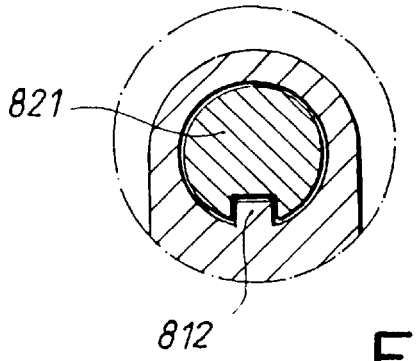
FIG. 3A is an enlarged view of the port and key engagement.

Referring to FIGS. 1 and 2, the automatic soap dispensing device according to the present invention comprises a housing 1, a cap 2, a seat 3 and a liquid container 4. Inside the seat 3, there is a motor 5 together with a drive device composed of a reducing gear set 6, a drive wheel 7 and a squeezer set 8 (as shown in FIG. 3).

The housing 1 is in a proper shape, with a soap liquid inspection window 11 at its top, and there is a soap discharging point 12 and a detecting hole 13 at its bottom. The cap 2 is designed to cover the opening on the back of the housing 1.

Figures 4, 4A:
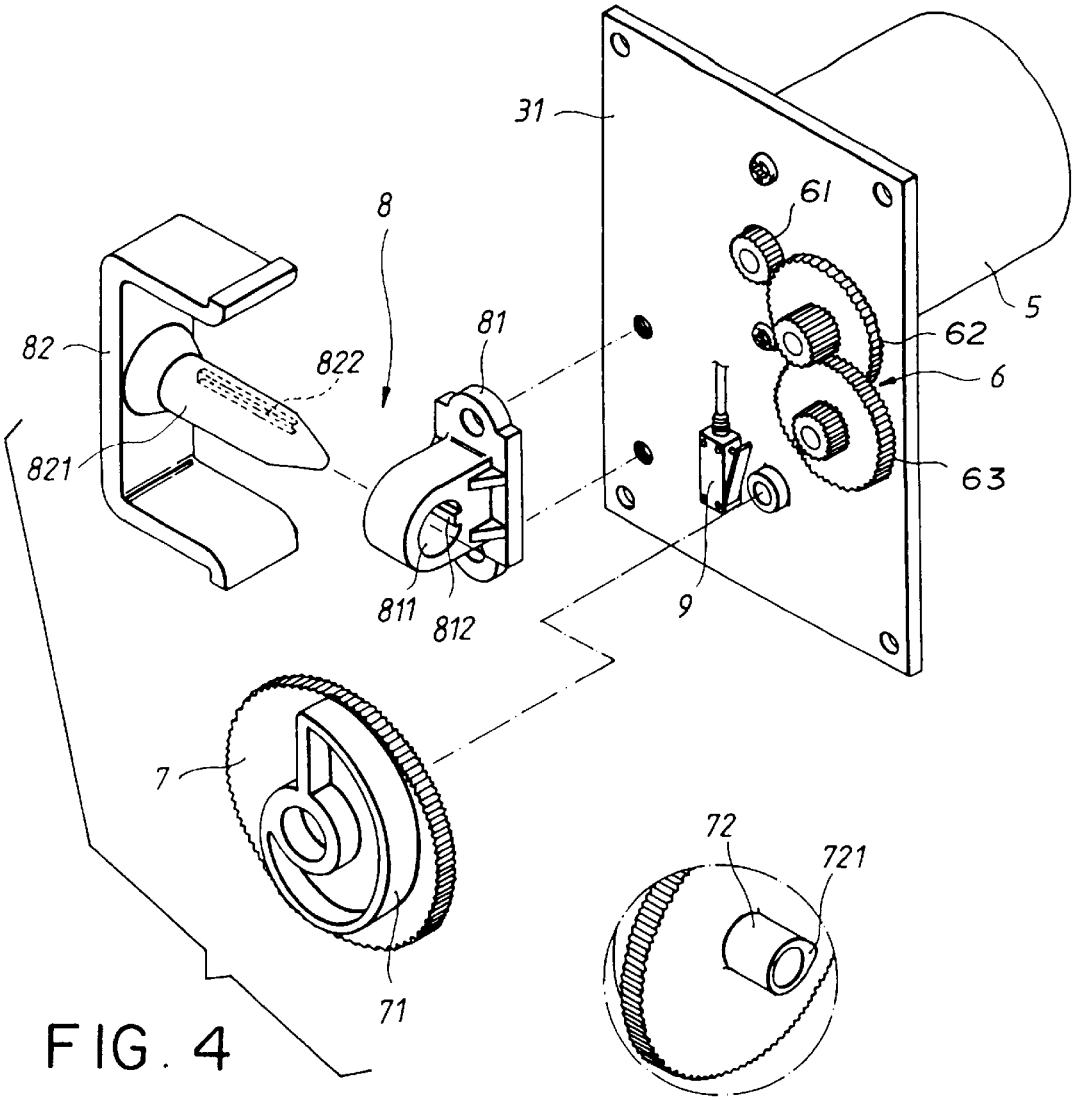
FIG. 4 is a developed perspective view of the preferred embodiment according to the present invention.
FIG. 4A is an enlarged view of the drive wheel and cam assembly.

The seat 3 is contained in housing 1. On the top of seat 3, a liquid container 4 is placed, and inside the seat, a support board 31 is installed. On the support board 31, the motor 5, the reducing gear set 6, the drive wheel 7, the squeezer set 8 and a microswitch 9 are fitted(as shown in FIG. 4).

The reducing gear set 6 has a transmission gear 61 engaged with the motor 5 and achieves speed reducing effect by transmission via two gear wheels 62 and 63. A pinion coaxially installed at the second gear wheel 63 is engaged with the drive wheel 7. The drive wheel 7 is coaxially fitted with a spiral eccentric wheel 71 on one side and a cam 72 having a raised portion 721 on the other side.

The squeezer set 8 is composed of a fixed seat 81 and an E-shaped squeezer 82. From the middle of the squeezer 82, a post 821 is extended through and slidably secured in a sleeve 811 in the fixed seat 81 so that the fixed seat 81 and the E-shaped squeezer are both fixed to the wall of the above-mentioned support board 31. A key 812 is extended from an inner wall of the sleeve 811, while a keyway 822 is formed on a wall of the post 821 so that the key 812 is located within the keyway 822.

Figure 5:
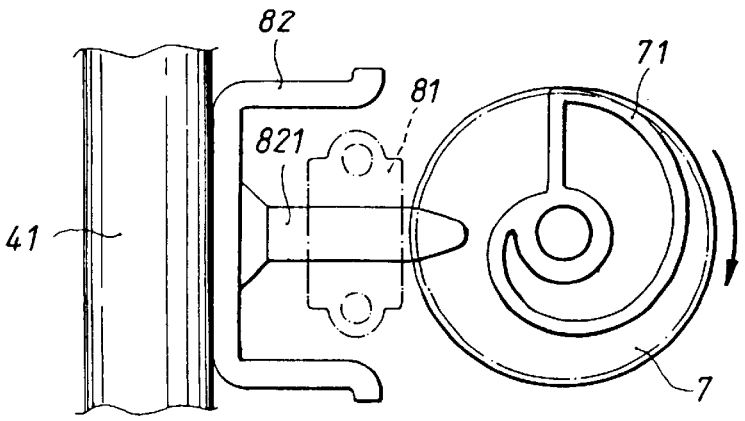
FIG. 5 illustrates the action of the eccentric wheel of the drive wheel before squeezing the hose.
Figure 6:
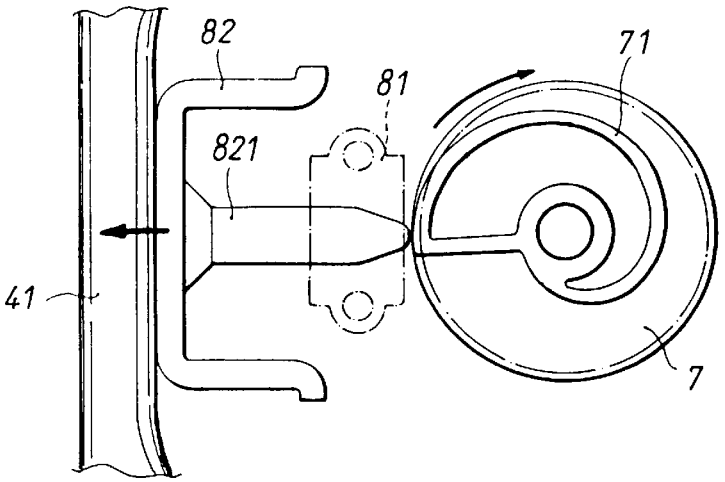
FIG. 6 illustrates the action of the eccentric wheel during squeezing the hose.
Figure 7:
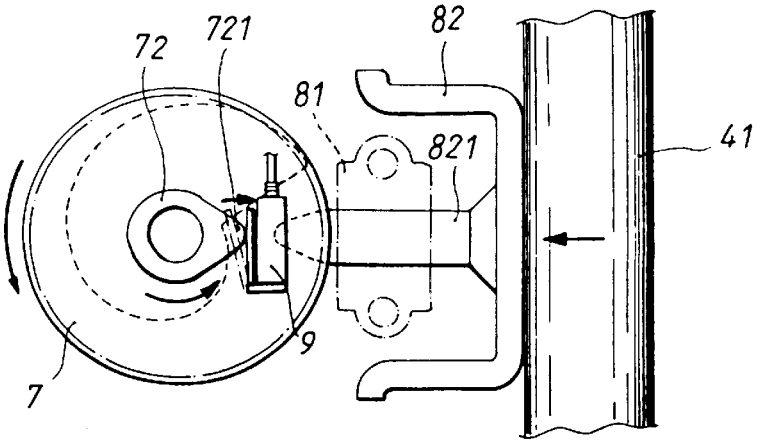
FIG. 7 illustrates the raised portion of the cam on the other side of the drive wheel while contacting the microswitch.

With the aforesaid components, when the soap dispensing device is activated to function, the motor 5 begins to drive and rotate the reducing gear set 6 which drives the drive wheel 7. Then, the spiral eccentric wheel 71 and the cam 72 on the drive wheel 7 begin to rotate coaxially (as shown in FIG. 5). The rotation of the eccentric wheel 71, by the principle of eccentric movement, pushes the post 821 and thus the squeezer 82 of the squeezer set 8 to displace forward [(as shown in FIG. 6)]. Consequently, squeezes a soap dispensing hose 41 in front of the squeezer set 82 so that a definite quantity of soap is dispensed automatically until the end of the post 821 passes the peak of the eccentric wheel

71. Then the soap dispensing hose 41 is no longer squeezed and returns to its initial position through its own elasticity. At this moment, the raised portion 721 on the cam 72 on the other side of drive wheel 7 contacts the microswitch 9 and thus motor 5 is stopped.

The operation and the new effect achieved by the automatic soap dispensing device according to the present invention are described in detail as follows:

(1) The automatic soap dispensing device according to the invention drives the squeezer set to act by the eccentric effect from the spiral eccentric wheel on the drive wheel without engagement of and transmission via gears. Every gear between the drive wheel and the motor receives the same and balanced drive to force the squeezer set to squeeze the hose in a gradual progress without much torque. Therefore, the squeezing can be achieved economically in terms of electric power consumption.

(2) When the drive wheel in the present invention is rotating, it drives the spiral eccentric wheel and the cam on both sides thereof. The eccentric wheel in turn drives the squeezer set to squeeze the hose while the cam contacts the microswitch to stop the motor.

(3) The squeezer set according to the present invention returns rapidly to its initial position by the elasticity of the hose. Since the drive wheel and the squeezer set act without engagement to any gear, there will not be any seizure of teeth and the squeezer set can return to its initial position easily.

(4) The present invention can also be applied to discharging soap liquid of high viscosity. Since the pressing force of the drive wheel and the motor reducing gear set is evenly taken up by every gear tooth, the gear teeth will not get deformed easily when the torque is large. Hence it is applicable to the soap liquid of high viscosity.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

We claim:

1. An automatic soap dispensing device, comprising:

a housing;

a cap upon which said housing is mounted;

a seat mounted within said housing;

a liquid container supported by said seat within said housing;

a support board mounted within said seat;

a motor fixed to said support board;

a driving mechanism fixed to said support board and driven by said motor, said driving mechanism including a reducing gear set, a drive wheel, a squeezer set and a microswitch;

a spiral eccentric wheel coaxially installed on one side of said drive wheel for rotation therewith, wherein a last gear of said reducing gear set has a coaxially installed pinion which engages said drive wheel for driving said drive wheel when said reducing gear set is driven by said motor; and a cam coaxially installed on the other side of said drive wheel for rotation therewith, said cam having a raised portion thereon, wherein said microswitch is fixed to said support board at a proper position so that said raised portion of said cam contacts said microswitch to stop said motor when said cam rotates into a certain position.

2. An automatic soap dispensing device, comprising:

a housing;

a cap upon which said housing is mounted;

a seat mounted within said housing;

a liquid container supported by said seat within said housing;

a support board mounted within said seat;

a motor fixed to said support board;

a driving mechanism fixed to said support board and driven by said motor, said driving mechanism including a reducing gear set, a drive wheel, a squeezer set and a microswitch;

a spiral eccentric wheel coaxially installed on one side of said drive wheel for rotation therewith, wherein a last gear of said driving gear set has a coaxially installed pinion which engages said drive wheel for driving said drive wheel when said reducing gear set is driven by said motor; and said squeezer set including a fixed seat via which said squeezer set is fixed to said support board, said fixed seat having a sleeve formed therein, a post extended through and slidably secured in said sleeve, an inner wall of said sleeve has a key extending therefrom and a wall of said post has a keyway formed thereon, said key being located within said keyway so that said post is slidably secured in said sleeve, a squeezer mounted on one end of said post, and said post extending from a middle of said squeezer.

* * * * *